United States Patent [19]

Gohsler

[11] 3,966,208

[45] June 29, 1976

[54] TETHERED BALL GOAL SCORING GAME

[76] Inventor: Robert Edward Gohsler, 10662 Gabacho Drive, San Diego, Calif. 92124

[22] Filed: June 5, 1975

[21] Appl. No.: 584,173

[52] U.S. Cl. ..... 273/101; 273/95 A
[51] Int. Cl.[2] ..... A63B 65/12
[58] Field of Search ..... 273/85, 95 R, 95 A, 273/97 R, 98, 101, 30

[56] References Cited

UNITED STATES PATENTS

| | | | |
|---|---|---|---|
| 828,825 | 8/1906 | Martin | 273/98 |
| 1,164,044 | 12/1915 | Williamson | 273/95 A |
| 2,083,850 | 6/1937 | Macy | 273/98 |
| 2,239,014 | 4/1941 | Peterson | 273/101 |
| 2,851,272 | 9/1958 | Shatzer | 273/95 R |
| 3,312,470 | 4/1967 | Ames | 273/1 M |
| 3,477,717 | 11/1969 | Clark | 273/30 |
| 3,656,747 | 4/1972 | Revell | 273/95 A |
| 3,762,708 | 10/1973 | Wing | 273/98 |
| 3,773,330 | 11/1973 | Glass | 273/100 |
| 3,794,324 | 2/1974 | Moe | 273/101 |
| 3,856,305 | 12/1974 | Vetter | 273/95 A |

FOREIGN PATENTS OR APPLICATIONS

| | | | |
|---|---|---|---|
| 473,700 | 8/1952 | Italy | 273/85 D |

*Primary Examiner*—Anton O. Oechsle
*Assistant Examiner*—Marvin Siskind
*Attorney, Agent, or Firm*—Brown & Martin

[57] ABSTRACT

A goal scoring game has a framed game board defining a playing area. An arcuate support member suspends a tethered game ball above the game board intermediate opposite sides of the frame. Strikers are slidably received in holes in the frame and strike the game ball to propel it in the direction of the opponent's goal for capture about the hook of the goal.

11 Claims, 3 Drawing Figures

TETHERED BALL GOAL SCORING GAME

BACKGROUND OF THE INVENTION

Games of skill and excitement have become quite popular in recent years for use in residential recreational rooms as well as taverns, hotel lobbies, stores and other such areas. Games of skill such as table tennis require a substantial amount of athletic ability on the part of a player, and consequently, one not gifted with athletic ability finds little enjoyment in such a game. Other games, such as air hockey, are very popular and rely for their popularity on the extraordinary excitement generated during the play. Air hockey is a vigorous game and to a great extent relies on brute force of the player as opposed to skill or accuracy. As a result, air hockey does not appeal to weaker, but competitive players. Electronic amusement games have also become quite popular, the most notable being electronic table tennis or variants thereof. These electronic games rely entirely on sensitive aiming skills of the participants and requires no athletic ability at all. while these games do require a certain amount of skill, they are characterized by the absense of excitement since all the action is accomplished by electronic means.

There has been a need for a game which is playable in residential recreation rooms as well as public places that requires the participants to exercise a reasonable amount of skill and generates substantial excitement during play. It is further advantageous for such a game to be played without significant athletic ability. This allows participation by competitive, but non-athletic participants.

SUMMARY OF THE INVENTION

It is an object of the invention to provide a new and improved game of skill.

Another object of the invention is to provide a new and improved game of excitement.

Another object of the invention is to provide a new and improved goal scoring game whereby a player propels a missile such as a game ball into his opponent's goal.

Another object of the invention is to provide a new and improved goal scoring game that is simply constructed.

Another object of the invention is to provide a new and improved goal scoring game that is easy to play.

Another object of the invention is to provide a new and improved goal scoring game that may be used by either two or four players.

Another object of the invention is to provide a new and improved goal scoring game that may be adapted for residential recreation, as well as public use.

In accordance with the above objects, the playing area is defined by a game board and a perimeter raised frame. A support member is connected to a brame side and suspends a tethered game ball above the game board. The support member is arcuate, and bowed outwardly from the game board in a nonobstructing manner.

The game ball may be a resilient or rigid ball or other object that is propelled toward the opponent's goal. The ball may be resilient to assume its original shape immediately after impact or it may be rigid to resist deformation.

Retaining means are disposed above the game board between the quiescent position of the ball and opposite ends of the frame. The retaining means form the goals and are composed of a pair of upstanding legs spaced further apart at the bottom than the top. An integral hook extends from the legs inwardly toward the opponents goal, orthogonally with respect to the legs. Strikers are received in holes in the frame and extend underneath the retaining means for contact with the ball. The strikers comprise elongated shanks that slide in and out of the holes in the frame and are permitted to pivot within those holes. Striker tips are integral with the shanks and are at an angle with respect thereto to provide substantial surface contact with the ball. The shanks are received in handles that are adapted to be gripped by the index, thumb and middle fingers of a player. A cushion is received about the shank between the handle and the frame.

The sides of the frame are provided with three holes; the center hole on each side designed for use when the game is to be played by two players and the side holes to be used when the game is played by four players. when played by two or four players, the game is played by manipulating the strikers to propel the game ball for capture within the opponent's hook. The ball is constantly in motion as no player can immobilize the ball or the tether other than by scoring a goal. Therefore, there are no "dead spots" in the course of a game.

The above and other objects of the invention will be apparent as the description continues and when read in conjunction with the appended drawings.

DETAILED DESCRIPTION OF THE DRAWINGS

Figure 1:
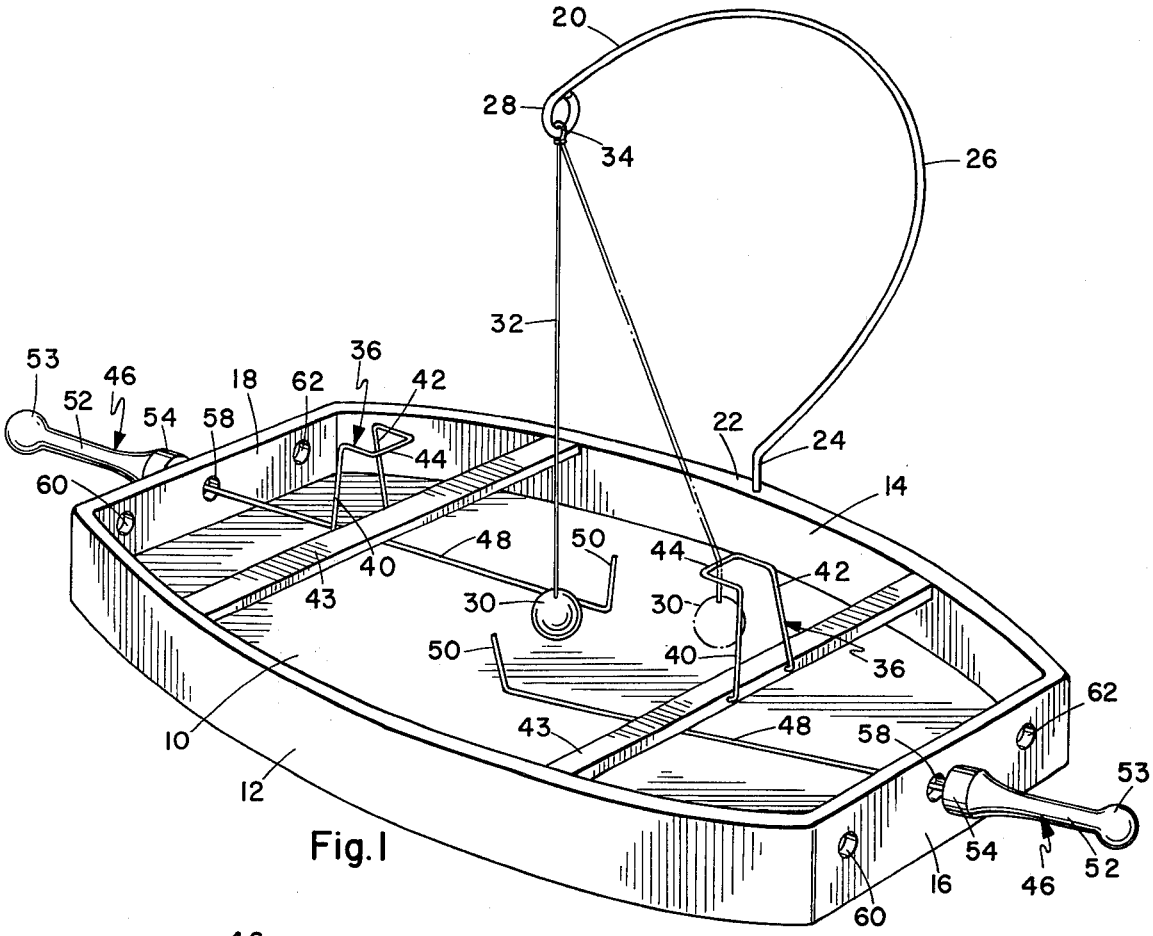
FIG. 1 is a perspective view of the complete game apparatus.
Figure 3:
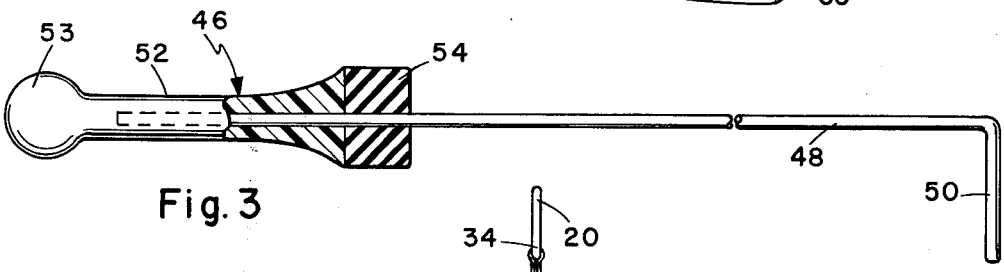
FIG. 3 is an enlarged side elevation view, partially cut away, of one striker.
Figure 2:
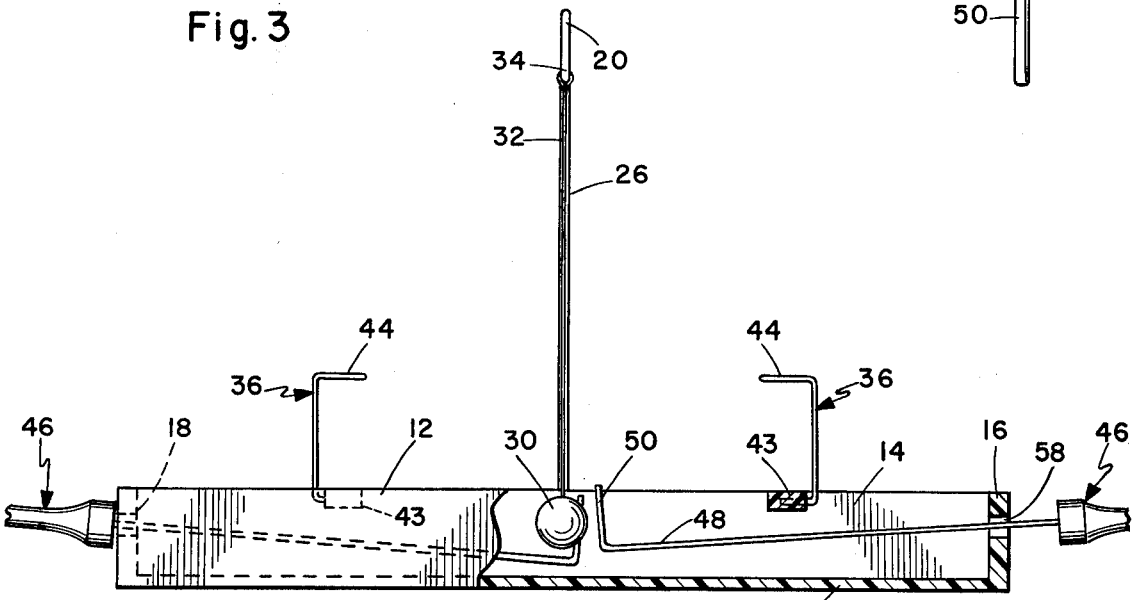
FIG. 2 is a side elevation view of the game, with a portion cut away.

The game board 10 is of a rectangular shape defined by a frame having long sides 12 and 14 and short sides 16 and 18. The sides 12 and 14 are arcuate, each having a center of curvature that is located behind the opposide side. An arcuate support member 20 is suspended above the game board 10 having its lower stem 24 connected directly to the top edge 22 of the frame side 14. The support member 20 is a substantially rigid member or alternatively, it may be flexible to induce unpredictability during the course of play. The bow portion 26 of the support member 20 bows outwardly away from the game board 10. The support member 20 loops back over the game board such that its curl 28 is substantially centrally disposed over the game board 10.

A ball 30 is hung from the curl 28 by means of a tether 32 having a loop 34 at its upper end. The tether 32 suspends the ball 30 such that the quiescent position of the ball is approximately at the same elevation as the upper edges of the frame. Approximately intermediate between the ball quiescent position and the frame sides 16 and 18, retaining means 36 is supported on elevator members 43. The elevator members 43 suspend the retaining means 36 above the game board 10, and those retaining means 36 are disposed to enable capture of the ball 30 therewithin, such capture representing a score for one of the competitors. The retaining means 36 is defined by legs 40, 42 that slope toward each other from bottom to top. An integral hook 44 is connected to the legs 40, 42 and extends inwardly toward the quiescent position of the ball 30. In the event one of the competitors strikes the ball 30 and it falls in the area between the legs 40, 42, it normally will pass into the area defined by the hook 44 and tether 32 becomes suspended on the hook 44.

The propulsion of the ball 30 is accomplished by means of strikers 46 that are slidably received in holes 58 formed in the frame sides 16, 18. The strikers include elongated shanks 48 and the upturned impact tips 50. The strikers 46 also include the handles 52, which may be gripped by either several fingers of the players or by the entire hand. The ball 53 at the handle tip makes it convenient to grasp the handle 52 with the thumb, index and third fingers of either the right or left hand of the player for easy manipulation. A cushion 54 is connected to the handle 52 and prevents destructive contact between the handle 52 and the frame sides 16 and 18. It is to be noted that the shank 48 is permitted some degree of pivotal movement in the holes 58, in addition to its slidable movement therethough. The elevation of the retaining means 36 above the game board 10 facilitates a great variety of motions of the strikers 46. The frame sides 16, 18 are provided with additional holes 60, 62 to accommodate two players on each side of the game board 10. Additional strikers 46 are necessary to accommodate four players.

In playing the game, each of the competitors manipulates his striker 46 in an attempt to strike the ball 30 with the impact tip 50, to urge that ball into his opponent's retaining means 36. The ball 30 may either be rigid or resilient. In the event a resilient ball is utilized, it is desirable that it be fabricated from a material with a relatively rapid recovery. The ball should be heavy enough to provide a true flight upon impact. The tether 32 may be fabricated from wire, twine or elastic; the latter material providing the greatest unpredictability in reaction to impact. The tether 32 and support member 20 are designed such that the support member 20 will not impede the flight of the ball 30. The ball 30 can even be propelled above the horizontal without being interfered with by the support member 20. Furthermore, it is contemplated that the hooks 44 may be as shown in the drawings or may be curvilinear or some other desired shape.

The game that has been described requires a substantial degree of skill to impel the ball 30 into the retaining means 36. The ball 30 makes numerous unpredictable bounces to generate excitement during the playing of the game. The game is also adaptable for use as a console model for cocktail lounges, bowling centers and other similar public amusement areas.

Modifications and adaptations in the method and materials of fabrication in the configuration and assemblage of the constituent elements are readily permissible within the scope of the instant invention; which changes are intended to be embraced therewithin.

Having described my invention, I now claim:

1. A goal scoring game comprising:

a game board defining a playing area, a tethered impact receiving missile normally disposed in a suspended quiescent position and adapted for swinging over the game board, support means for suspending said missile over said game board, said support means bowed outwardly of same game board in a nonobstructing relationship with the tether of a missile propelled to above said support means, retaining means intermediate a side of the game board and the quiescent position of said missile, and projecting toward the missile quiescent position defining a goal scoring zone reachable only by propelling said missile to adjacent said retaining means and then behind the same for retention within the goal scoring zone, and striker means slidably associated with said game board and disposed below said retaining means, said striker means adapted for striking said missile and propelling the same in a generally pendulum motion toward the goal defining said playing area, said striker means includes an elongated shank with an impactor connected to the shank, said striker means slidably received in holes in opposite sides of said frame whereby the end of the striker means opposite the impactor can be manipulated to strike said missile and propel the same into the vicinity of the retaining means for retention therewith.

2. The goal scoring game of claim 1, wherein:

said missile is a ball.

3. The goal scoring game of claim 1, wherein:

said missile is a resilient ball adapted to recover its original spherical shape immediately after impact.

4. The goal scoring game of claim 1, wherein:

said retaining means comprises an inwardly projecting hook.

5. The goal scoring game of claim 4, wherein:

said retaining means comprises a pair of legs spaced further apart at the bottom than at the top to define a missile receiving area.

6. The goal scoring game of claim 1 wherein:

a pair of retaining means are disposed intermediate between the missile quiescent position and the opposite sides of said game board.

7. The goal scoring game of claim 1, wherein:

said retaining means comprises an inwardly projecting hook facing toward the missile quiescent position and retention of said missile is possible only by propelling said missile to behind said hook and within the area defined by the hook.

8. The goal scoring game of claim 1, further comprising:

an elevator member supporting said retaining means above said game board and said striker means.

9. The goal scoring game of claim 1, wherein:

said impactor is integral with said shank and is disposed orthogonally with respect to said shank.

10. The goal scoring game of claim 1, wherein:

said striker means includes a handle adapted to be grasped by index, thumb and middle fingers of a player.

11. The goal scoring game of claim 10, wherein said striker means further comprises:

a cushioning member disposed between said handle and said game board to cushion the impact of said striker handle against said game board.

* * * * *